US009088118B2

(12) United States Patent
Morikawa

(10) Patent No.: US 9,088,118 B2
(45) Date of Patent: Jul. 21, 2015

(54) JOINT CONNECTOR

(71) Applicant: YAZAKI CORPORATION, Minato-ku, Tokyo (JP)

(72) Inventor: Taishi Morikawa, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 20 days.

(21) Appl. No.: 14/045,523

(22) Filed: Oct. 3, 2013

(65) Prior Publication Data

US 2014/0038444 A1 Feb. 6, 2014

Related U.S. Application Data

(63) Continuation of application No. PCT/JP2012/001244, filed on Feb. 23, 2012.

(30) Foreign Application Priority Data

Apr. 5, 2011 (JP) ..... 2011-083493

(51) Int. Cl.

| | |
|---|---|
| ***H01R 13/62*** | (2006.01) |
| ***H01R 24/84*** | (2011.01) |
| ***H01R 13/28*** | (2006.01) |
| ***H01R 31/08*** | (2006.01) |
| *H01R 4/18* | (2006.01) |

(52) U.S. Cl.

CPC ..... *H01R 24/84* (2013.01); *H01R 13/28* (2013.01); *H01R 31/08* (2013.01); *H01R 4/185* (2013.01)

(58) Field of Classification Search

CPC ..... H01R 13/4223; H01R 13/5208; H01R 13/501; H01R 13/62; H01R 4/18; H01R 13/05; H01R 13/6271

USPC ..... 439/701

See application file for complete search history.

(56) References Cited

U.S. PATENT DOCUMENTS

| | | | | |
|---|---|---|---|---|
| 5,997,361 | A * | 12/1999 | Driscoll et al. | 439/701 |
| 6,319,071 | B1 | 11/2001 | Sato | |
| 6,332,811 | B1 * | 12/2001 | Sato | 439/701 |

(Continued)

FOREIGN PATENT DOCUMENTS

| | | | |
|---|---|---|---|
| CN | 101652904 | A | 2/2010 |
| JP | 03192669 | A | 8/1991 |

(Continued)

OTHER PUBLICATIONS

Communication dated Feb. 10, 2015, issued by the Japan Patent Office in corresponding Japanese Application No. 2011-083493.

(Continued)

*Primary Examiner* — Truc Nguyen

(74) *Attorney, Agent, or Firm* — Sughrue Mion, PLLC

(57) ABSTRACT

A crimp terminal is inserted in one of terminal accommodating chambers provided for a housing of a joint connector to be electrically connected to another crimp terminal in another one of the terminal accommodating chambers. The crimp terminal includes: a first engagement portion formed at one end in a direction orthogonal to an insertion direction that the crimp terminal is inserted into the terminal accommodating chamber; and a second engagement portion which is provided at the other end which can be engaged with the first engagement portion. The first engagement portion is engaged with the second engagement portion of another crimp terminal for electrical connection of the two or more crimp terminals.

3 Claims, 9 Drawing Sheets

(56) References Cited

U.S. PATENT DOCUMENTS

| | | | | |
|---|---|---|---|---|
| 6,386,925 | B1 * | 5/2002 | Sato et al. | 439/701 |
| 6,402,568 | B1 * | 6/2002 | Nagai | 439/701 |
| 2002/0002016 | A1 | 1/2002 | Sato et al. | |
| 2002/0006752 | A1 | 1/2002 | Sato | |
| 2012/0094545 | A1 * | 4/2012 | Lorenzo Riera et al. | 439/701 |
| 2014/0349524 | A1 * | 11/2014 | Sakamoto | 439/701 |

FOREIGN PATENT DOCUMENTS

| | | | |
|---|---|---|---|
| JP | 6-2570 | U | 1/1994 |
| JP | 11-97094 | A | 4/1999 |
| JP | 2002033154 | A | 1/2002 |
| JP | 3433635 | B2 | 8/2003 |
| JP | 2006244764 | A | 9/2006 |
| JP | 2010-129189 | A | 6/2010 |

OTHER PUBLICATIONS

Office Action issued Mar. 25, 2015 from the State Intellectual Property Office of P.R. China in the counterpart Chinese Application No. 2012180017515.1 (pp. 1-6).

Communication dated Nov. 25, 2014, issued by the Japan Patent Office in corresponding Japanese Application No. 2011-083493.

* cited by examiner

JOINT CONNECTOR

This application is a continuation of International Application No. PCT/JP2012/001244, filed Feb. 23, 2012, and based upon and claims the benefit of priority from Japanese Patent Application No. 2011-083493, filed Apr. 5, 2011, the entire contents of all of which are incorporated herein by reference.

TECHNICAL FIELD

The present invention relates to a crimp terminal electrically connected to another crimp terminal and a joint connector including such crimp terminals and a housing having plural terminal accommodating chambers to which the crimp terminals are individually inserted.

BACKGROUND ART

As one of conventional joint connectors which electrically connect plural crimp terminals inserted in plural terminal accommodating chambers provided for a housing, a joint connector described in JP 2010-129189 A (PTL 1) is proposed.

In the conventional joint connector, female-type crimp terminals are individually inserted in the terminal accommodating chambers to be brought into contact with a busbar as a male-type terminal provided for the housing. The crimp terminals are thus electrically connected to one another.

FIG. 1 is a view illustrating the conventional joint connector described in PTL 1. As illustrated in FIG. 1, the joint connector 100 substantially includes: crimp terminals 102, each of the crimp terminals 102 crimped to a conductor of one of wires 101; a housing 112 including plural terminal accommodating chambers 111 in which the crimp terminals 102 are inserted; and a busbar 113 integrally formed on the housing 112.

Each crimp terminal 102 includes a terminal portion 103 coming into contact with the busbar 113 and a crimp portion 104 crimped to one of the wires 101.

The terminal accommodating chambers 111 of the housing 112 are provided with partition walls 114 each separating two of the terminal accommodating chambers 111 adjacent to each other in the width direction which is orthogonal to the direction that the crimp terminals 102 are inserted.

The busbar 113 attached to a base 115 of the housing 112 is provided with contact portions 116 which are electrically connected to the terminal portions 103 of the crimp terminals 102 inserted in the terminal accommodating chambers 111.

The crimp terminals 102 are individually inserted in the terminal accommodating chambers 111 to allow the terminal portions 103 of the crimp terminals 102 to come into contact with the contact portions 116. The crimp terminals 112 are thus electrically connected to one another through the busbar 113.

SUMMARY OF INVENTION

In the conventional joint connector 100, the crimp terminals are electrically connected through the busbar 113 attached to the housing 112. Accordingly, the housing 112 needs to include a space to attach the busbar 113. It is therefore difficult to miniaturize the joint connector 100.

Moreover, the conventional joint connector 100 needs constituent components to attach the busbar 113 to the housing 112 and includes a lot of constituent components. Accordingly, the joint connector 100 requires the process to manage the constituent components, and the manufacturing cost thereof is high.

The present invention was made to solve the conventional problems, and an object of the present invention is to provide a crimp terminal and a joint connector which can be miniaturized and manufactured at lower cost.

In order to achieve the aforementioned object, a crimp terminal according to a first aspect of the present invention is a crimp terminal which is inserted into one of terminal accommodating chambers provided for a housing of a joint connector to be electrically connected to another one of the crimp terminal in another one of the terminal accommodating chambers, the crimp terminal including: a first engagement portion which is formed at one end in a direction orthogonal to a direction that the crimp terminal is inserted into the terminal accommodating chamber; and a second engagement portion which is formed at the other end in the direction orthogonal to the direction that the crimp terminal is inserted into the terminal accommodating chamber and has a shape engageable with the first engagement portion. The first engagement portion is engaged with the second engagement portion of another one of the crimp terminal for electrical connection of the two or more crimp terminals.

According to the crimp terminal of the first aspect of the present invention, by engaging the first engagement portion of the crimp terminal with the second engagement portion of another one of the crimp terminal, the two or more crimp terminals can be directly connected to one another without using a busbar.

Accordingly, the housing does not need to include a space to attach a busbar, and the joint connector can be therefore miniaturized. Moreover, the number of constituent components used to attach a busbar to the housing can be reduced. This makes it possible to reduce the process to manage constituent components and accordingly reduce the manufacturing cost.

It is therefore possible to provide the crimp terminal which can be reduced in size and manufacturing cost.

Preferably, the first engagement portion is a female type which sandwiches the second engagement portion of another one of the crimp terminal for electrical connection. Preferably, the second engagement portion is a male type which is sandwiched by the first engagement portion of another one of the crimp terminal.

With such a configuration, two or more crimp terminals can be secured electrical connection without using a busbar.

A joint connector according to a second aspect of the present invention includes: crimp terminals according to the first aspect of the present invention; a housing including a plurality of terminal accommodating chambers, each of the crimp terminals inserted into each of the terminal accommodating chambers; partition walls each separating two of the terminal accommodating chambers which are adjacent to each other in a width direction orthogonal to a direction that the crimp terminals are inserted into the terminal accommodating chambers; and slits each formed in each of the partition walls from a port through the direction that the crimp terminals are inserted into the terminal accommodating chambers. One of the crimp terminals and another one of the crimp terminals are individually inserted in adjacent two of the terminal accommodating chambers. The first engagement portion formed on the one of the crimp terminals and the second engagement portion formed on the another one of the crimp terminals are engaged with each other and located in one of the slits.

According to the joint connector of the second aspect of the present invention, each of the slits is formed in each of the partition walls separating the terminal accommodating chambers. Accordingly, two crimp terminals individually inserted in two of the terminal accommodating chambers adjacent to each other can be directly connected to each other, thus implementing a joint connector not requiring a busbar.

It is therefore possible to provide a joint connector which can be reduced in size and manufacturing cost.

DESCRIPTION OF EMBODIMENTS

First Embodiment

Hereinafter, a description is given of a crimp terminal and a joint connector according to each embodiment of the present invention with reference to the drawings. At first, a crimp terminal according to a first embodiment is described with reference to FIG. 2.

The crimp terminal according to the first embodiment is a terminal which is inserted in a terminal accommodating chamber provided for a housing of the joint connector to be electrically connected to a crimp terminal inserted in another terminal accommodating chamber.

Figure 1:
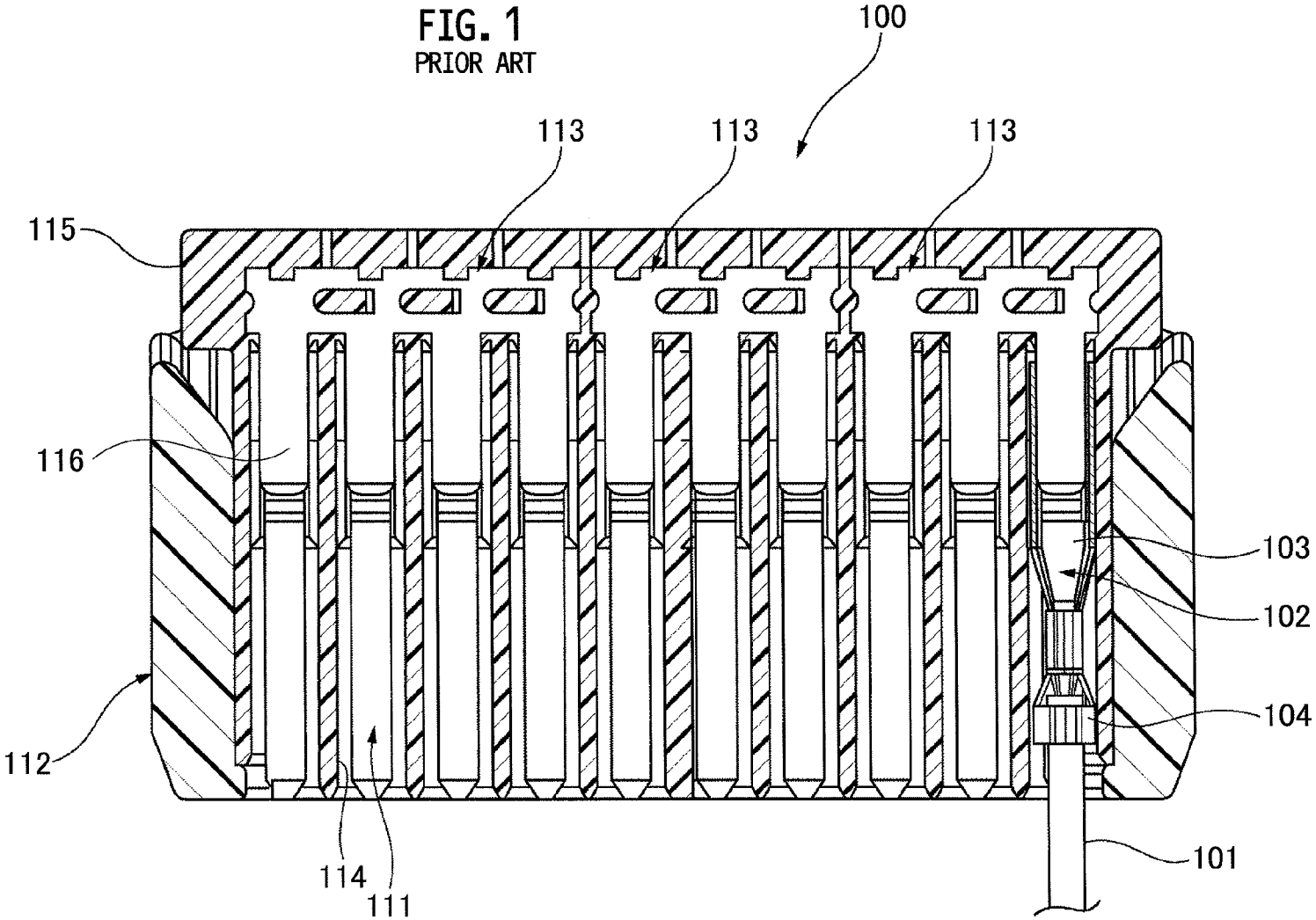
FIG. 1 PRIOR ART
FIG. 1 is a view illustrating a conventional joint connector.
Figure 2:
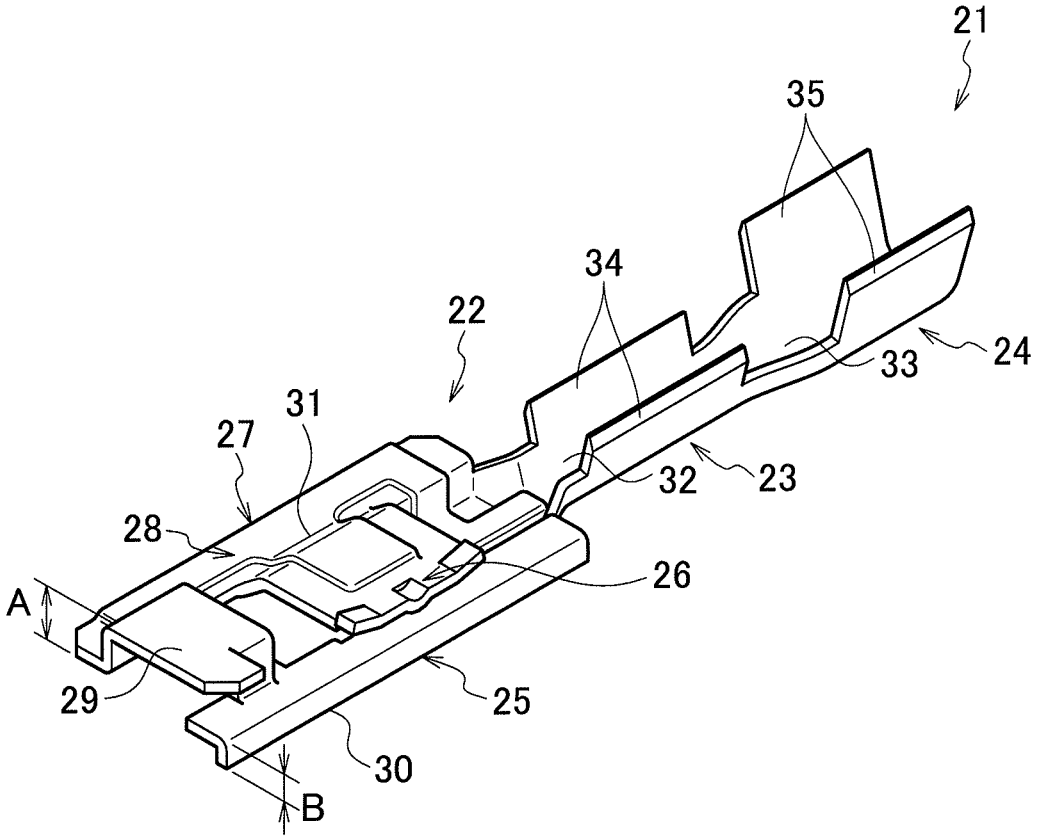
FIG. 2 is a perspective view illustrating a crimp terminal according to a first embodiment of the present invention.

As illustrated in FIG. 2, a crimp terminal 21 according to the first embodiment schematically includes: a terminal engagement portion 22 configured to come into contact with another crimp terminal; a conductor crimp portion 23 configured to be crimped to a conductor of a wire 41 (see FIGS. 4 and 5 later described); and a jacket crimp portion 24 configured to be crimped to a jacket of the wire 41.

The terminal engagement portion 22 includes: a first engagement portion 26 formed at one end 25 in a width direction Y orthogonal to an insertion direction X that the crimp terminal 21 is inserted in one of later-described terminal accommodating chambers 12 (see FIG. 5); and a second engagement portion 28 which is formed at the other end 27 in the width direction Y and can be engaged with the first engagement 26. The details of the first engagement portion 26 and the second engagement portion 28 are described later.

At a top end of the terminal engagement portion 22, a box portion 29 is formed. Accordingly, when the crimp terminal 21 is inserted into one of the later-described terminal accommodating chambers 12 (see FIGS. 4 and 5), the box portion 29 comes into contact with an inner wall of the terminal accommodating chamber 12 to restrict the movement of the crimp terminal 21 (movement in a direction orthogonal to the insertion direction X and width direction Y, for example, in a direction Z (see FIG. 5)).

At the one end 25 of the terminal engagement portion 22, a fold portion 30 is formed. The fold portion 30 is folded downward and is extended in the insertion direction X that the crimp terminal 21 is inserted in the terminal accommodating chamber 12 (see FIGS. 4 and 5). At the other end 27 of the terminal engagement portion 22, a bead 31 is formed. The fold portion 30 and the bead 31 can ensure strength against pressure in the direction orthogonal to the insertion direction X.

The conductor crimp portion 23 and jacket crimp portion 24 include a bottom wall 32, a second bottom wall 33, first crimp pieces 34, and second crimp pieces 35, respectively. The first bottom wall 32 and the second bottom wall 33 are configured to position the core of the wire 41 (see FIGS. 4 and 5). The first crimp pieces 34 are stood from the first bottom wall 32 by bending. The second crimp pieces 35 are stood from the second bottom wall 33 by bending.

Figure 4:
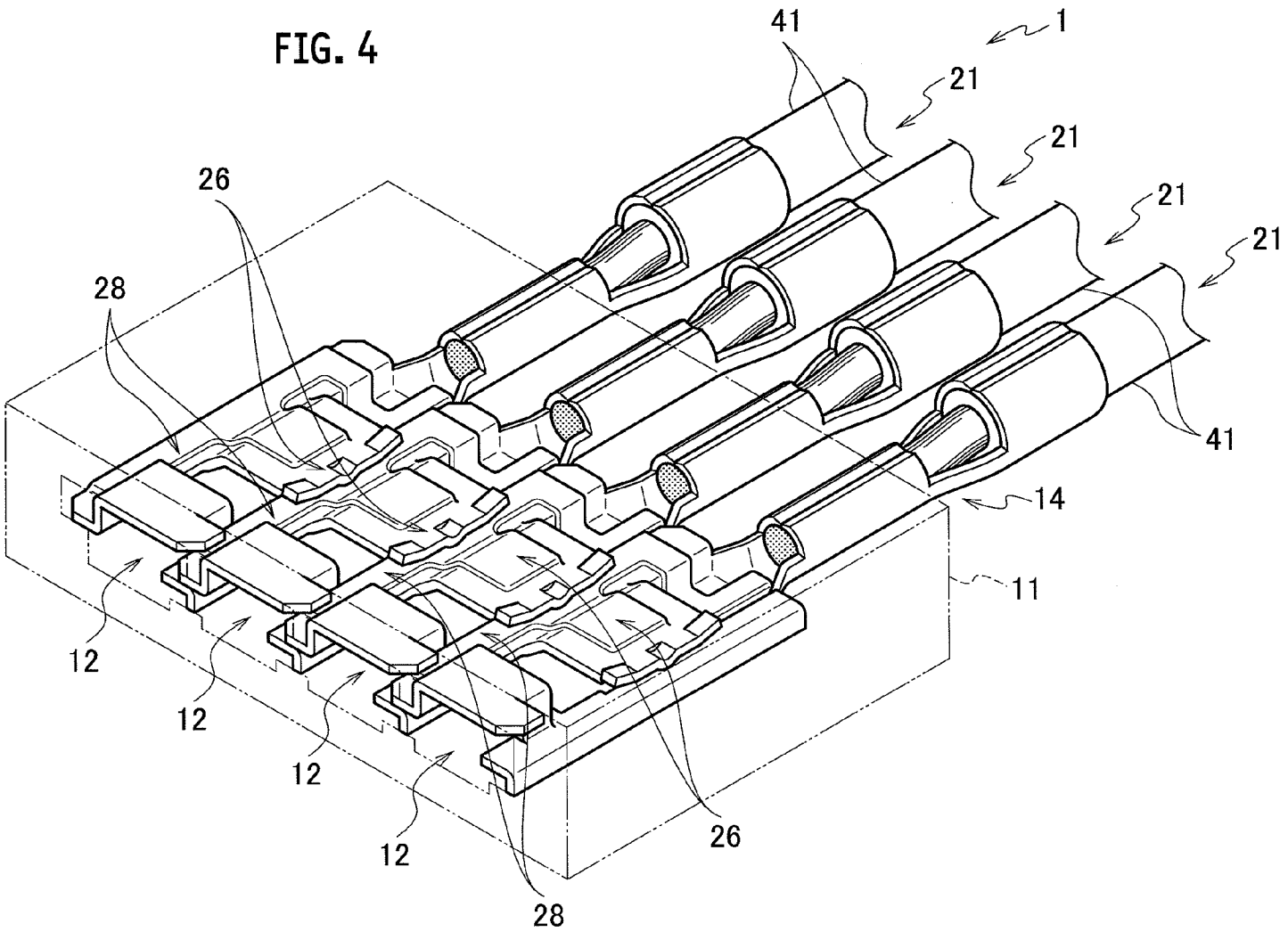
FIG. 4 is a perspective view illustrating a joint connector according to the first embodiment of the present invention.
Figure 5:
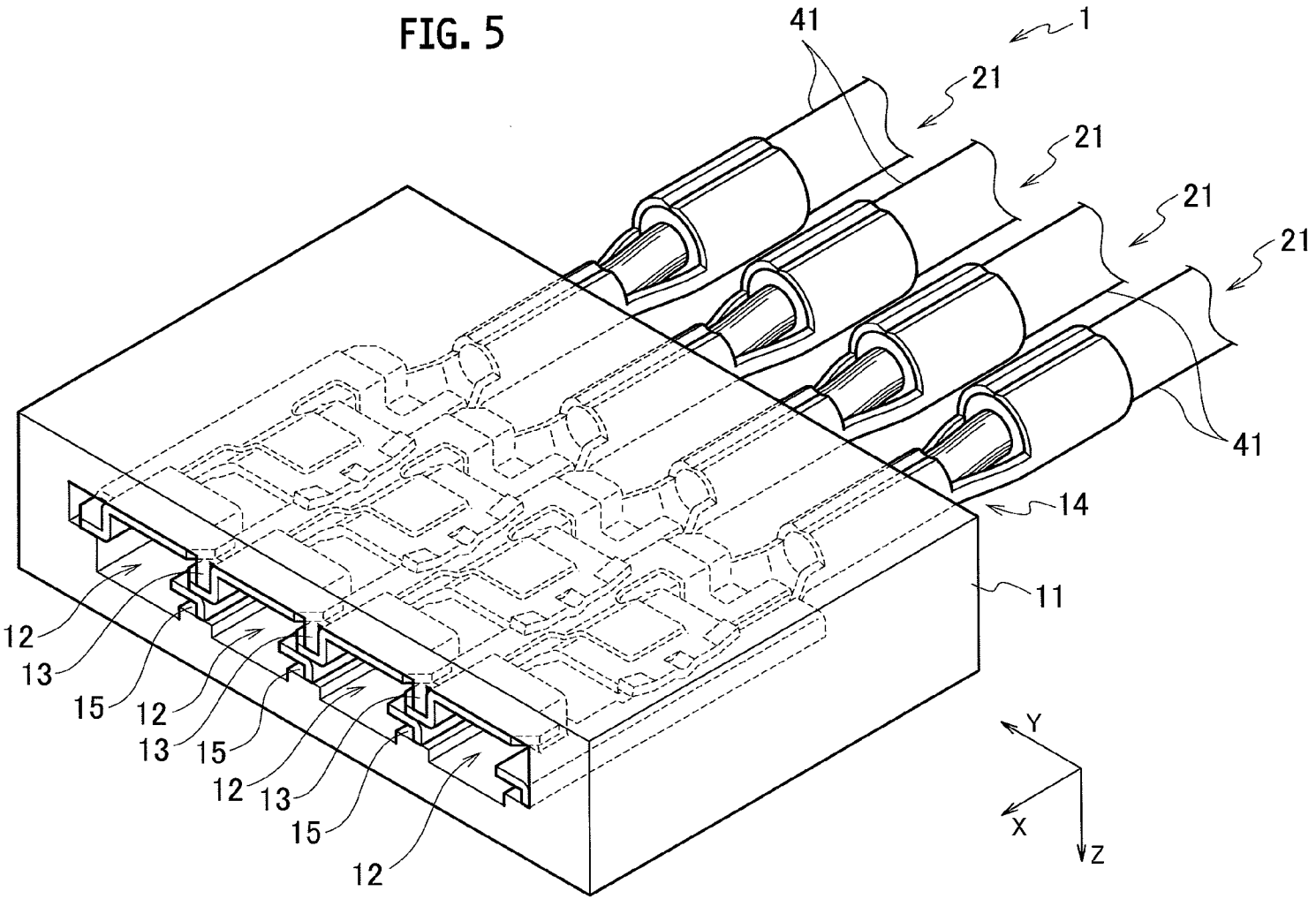
FIG. 5 is a perspective view illustrating the joint connector and a housing according to the first embodiment of the present invention.

The first crimp pieces 34 and the second crimp pieces 35 are bent and crimped to the wire 41 positioned on the first bottom wall 32 and second bottom wall 33 so as to wrap around the wire 41 (see FIGS. 4 and 5). The wire 41 is thus fixed.

The crimp terminal 21 is formed by bending a single conductive metallic plate. Accordingly, the terminal engagement portion 22 (including the first engagement portion 26, the second engagement portion 28, the box portion 29, the fold portion 30, and the like) can be formed simultaneously with the first crimp pieces 34 and the second crimp pieces 35.

Next, the first engagement portion 26 and the second engagement portion 28, which are formed in the terminal engagement portion 22, are described in detail with reference to FIG. 3.

In the crimp terminal 21 according to the first embodiment, the first engagement portion 26 is engaged with the second engagement portion 28 formed in another crimp terminal 21 to electrically connect the two or more crimp terminals.

Figure 3:
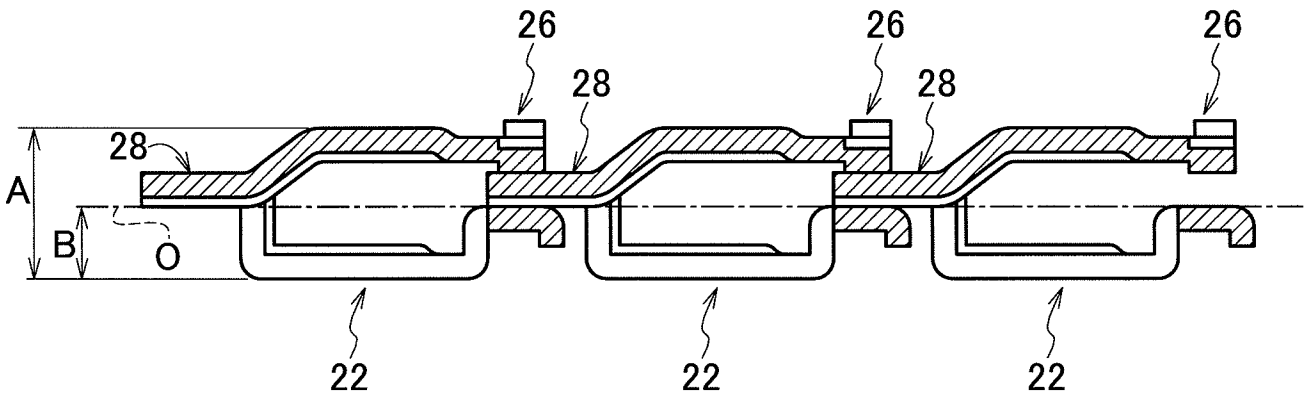
FIG. 3 is a cross-sectional view illustrating connection of the crimp terminals according to the first embodiment of the present invention.

As illustrated in FIG. 3, the first engagement portion 26 is a female type (a type of a pair of elastic pieces) which sandwiches the second engagement portion 28 formed in another crimp terminal for electrical connection.

The second engagement portion 28 is a male type (a plate type) which is sandwiched by the first engagement portion 26 of another crimp terminal for electrical connection.

Accordingly, as illustrated in FIG. 3, the first engagement portion 26 elastically sandwiches the second engagement portion 28 formed in another crimp terminal to be engaged with the same. The second engagement portion 28 is elastically sandwiched by the first engagement portion 26 formed in another crimp terminal. Two or more crimp terminals are thus electrically connected.

As described above, in the terminal engagement portion 22 of the crimp terminal 21, the first engagement portion 26 functioning as a female terminal is formed at the one end 25, and the second engagement portion 28 functioning as a male terminal is formed at the other end 27 (see FIG. 2). Accordingly, two crimp terminals can be electrically connected to each other without using a busbar, and two or more crimp terminals 21 can be successively connected to one another.

Moreover, the first engagement portion 26 has elasticity and firmly sandwiches the second engagement portion 28 of another crimp terminal. Accordingly, the manufacturing yield of the crimp terminal 21 and joint connector 1 (see FIGS. 4 and 5) can be considerably increased.

Moreover, the second engagement portion 28 is formed to have a height A different from a height B of the fold portion 30 constituting one of the elastic pieces of the first engagement portion 26. To be specific, the height A of the second engagement portion 28 is about twice the height B of the fold portion 30 (see FIGS. 2 and 3).

Accordingly, when the crimp terminals 21 are connected to each other, as illustrated in FIG. 3, the lower surfaces of the second engagement portions 28 of the connected crimp terminals 21 are positioned on a straight line O. The plural crimp terminals 21 are connected in a line. In other words, the connecting state of the crimp terminals is linear.

If the crimp terminals are connected to one another when the height A of the second engagement portion 28 is set equal to the height B of the fold portion 30, the crimp terminals are not connected in a linear fashion, and the terminal accommodating chambers 12 (see FIGS. 4 and 5) need to be formed according to the connecting state.

However, since the height A of the second engagement portion 28 is set equal to about twice the height B of the fold portion 30, the crimp terminals are connected in a linear fashion. Accordingly, the terminal accommodating chambers 12 can be formed in a liner shape (see FIGS. 4 and 5).

As described above, in the crimp terminal 21, the first engagement portion 26 is formed at the one end 25 of the terminal engagement portion 22, and the second engagement 28 which can be engaged with the first engagement portion 26 is formed at the other end 27 of the terminal engagement portion 22.

Accordingly, by engaging the first engagement portion 26 of the crimp terminal 21 with the second engagement portion 28 of another crimp terminal, two or more crimp terminals can be directly connected without using a busbar.

Moreover, since two or more crimp terminals 21 can be directly connected without using a busbar, the housing 11 does not need a space to attach a busbar. The joint connector 1 can be therefore miniaturized.

Furthermore, since two or more crimp terminals can be directly connected without using a busbar, the number of constituent components used to attach a busbar to the housing 11 can be reduced. Accordingly, this can reduce the process to manage constituent components and reduce the manufacturing cost.

It is therefore possible to provide the crimp terminal 21 which can be reduced in size and manufacturing cost.

According to the crimp terminal 21, the first engagement portion 26 is a female type and the second engagement portion 28 is a male type. Accordingly, the first engagement portion 26 sandwiches the second engagement portion 28 of another crimp terminal, and the second engagement portion 28 is sandwiched by the first engagement portion 26 of another crimp terminal. This can secure electrical connection of two or more crimp terminals without using a busbar.

Next, the joint connector according to the first embodiment is described with reference to FIGS. 4 and 5.

As illustrated in FIGS. 4 and 5, a joint connector 1 substantially includes: the housing 11 which is made of resin and has a box shape; and the crimp terminals 21 described with reference to FIGS. 2 and 3.

The housing 11 includes: the plural terminal accommodating chambers 12 to which the crimp terminals 21 crimped to the wires 41 are individually inserted; and the partition walls 13 each separating two of the terminal accommodating chambers 12 adjacent in the width direction Y which is orthogonal to the insertion direction X that the crimp terminals 21 are inserted (see FIG. 5).

The terminal accommodating chambers 12 are formed at intervals in the width direction Y which is orthogonal to the direction X that the crimp terminals 21 are inserted (see FIG. 5). Moreover, as described above, when the crimp terminals are connected, the crimp terminals form a linear connecting state. The terminal accommodating chambers 12 are therefore formed into a linear shape in the width direction according to the linear connecting state.

Each of the partition walls 13 includes a slit 15 extending in the insertion direction X (see FIG. 5) from an insertion port 14 through which the crimp terminals 21 are inserted. In this slit 15, the first engagement portion 26 and the second engagement portion 28 (see FIG. 4), which are formed in two crimp terminals 21 inserted in two of the terminal accommodating chambers 12 adjacent to each other, are located and engaged with each other.

As described above, in the joint connector 1 according to the first embodiment, the slits 15 are formed in the partition walls 13 separating the terminal accommodating chambers 12. Accordingly, two crimp terminals individually inserted in adjacent two of the terminal accommodating chambers can be directly connected to each other.

Moreover, the crimp terminal 21 can be directly connected to other crimp terminal when the crimp terminal 21 is inserted through the insertion port 14 into the terminal accommodating chamber 12. Furthermore, each crimp terminal 21 can be inserted into one of the terminal accommodating chambers 12 with the first engagement portion 26 being engaged with the second engagement portion 28 of another crimp terminal.

Other Embodiments

Next, a description is given of crimp terminals according to other embodiments in detail with reference to FIGS. 6 to 9. FIGS. 6 to 9 are views illustrating the crimp terminals according to other embodiments.

The crimp terminals and joint connectors according to the other embodiments have substantially the same configurations as the crimp terminal 21 and joint connector 1 according to the first embodiment. The same configurations are not described. In the following description, the same constituent elements as the crimp terminal 21 according to the first embodiment are given the same reference numerals.

First engagement portions 56, 66, 76, and 86 of crimp terminals 51, 61, 71, and 81 illustrated in FIGS. 6 to 9 are female types each of which sandwiches the second engagement portion 28 of another crimp terminal for electric connection.

Figure 6:
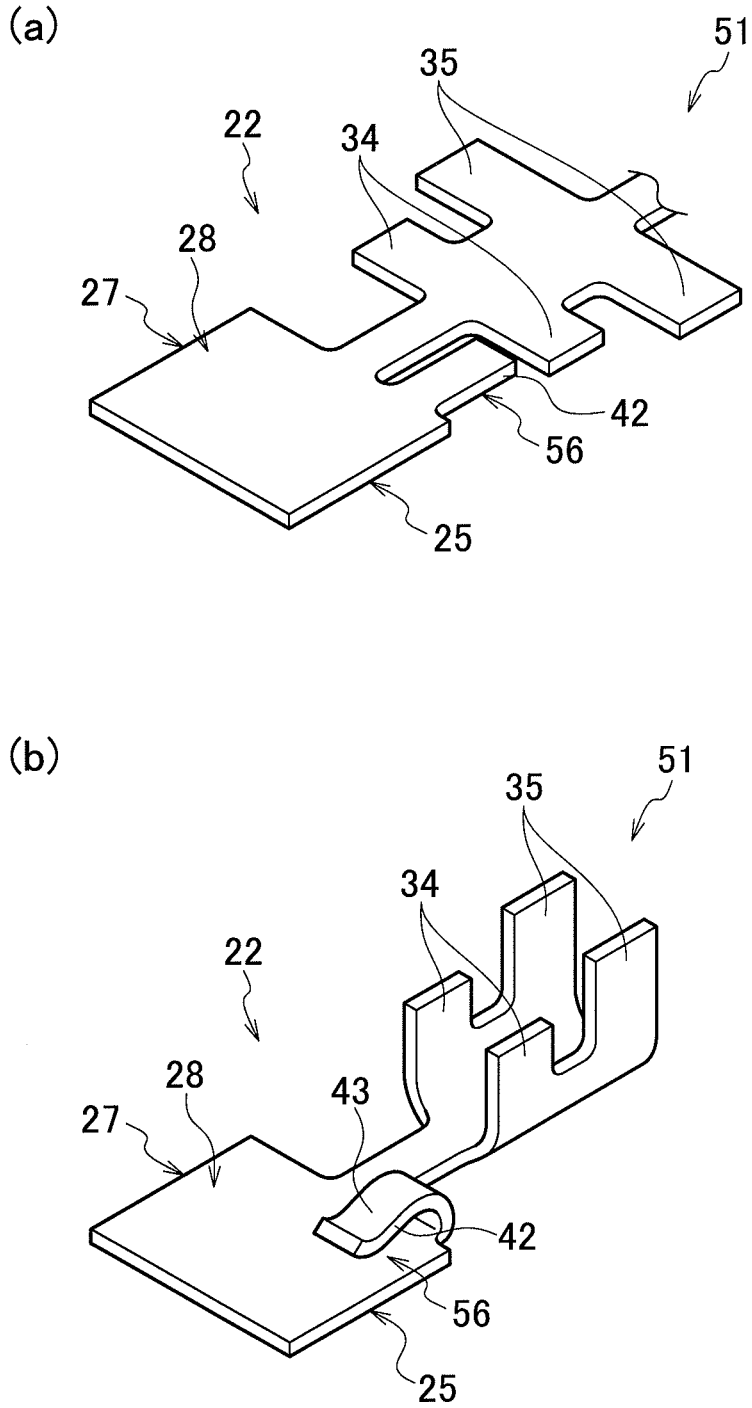
FIGS. 6(*a*) and 6(*b*) are perspective views illustrating a crimp terminal according to one of the other embodiments of the present invention.

As illustrated in FIGS. 6(*a*) and 6(*b*), in the crimp terminal 51 according to one of the other embodiments, the first engagement portion 56 is formed by bending a first plate piece 42 extended from the terminal engagement portion 22 to the same side as the conductor crimp portion 23 and jacket crimp portion 24 (see FIG. 2).

As illustrated in FIG. 6(*b*), the first plate piece 42 is provided with a first recess portion 43 which is formed by bending at substantially the center of the first plate piece 42.

The first recess portion 43 of the first plate piece 42 and the terminal engagement portion 22 elastically sandwich the second engagement portion 28 formed in another crimp terminal. The first engagement portion 56 is thus engaged with the second engagement portion 28 of another crimp terminal.

As illustrated in FIG. 6(*b*), in the crimp terminal 51, the first engagement portion 56 is formed from the terminal engagement portion 22 to the same side as the conductor crimp portion 23 and jacket crimp portion 24 (see FIG. 2). Accordingly, to insert the crimp terminal 51 into the terminal accommodating chamber 12, the crimp terminal 51 is first connected to another crimp terminal and then inserted into the terminal accommodating chambers 12.

Figure 7:
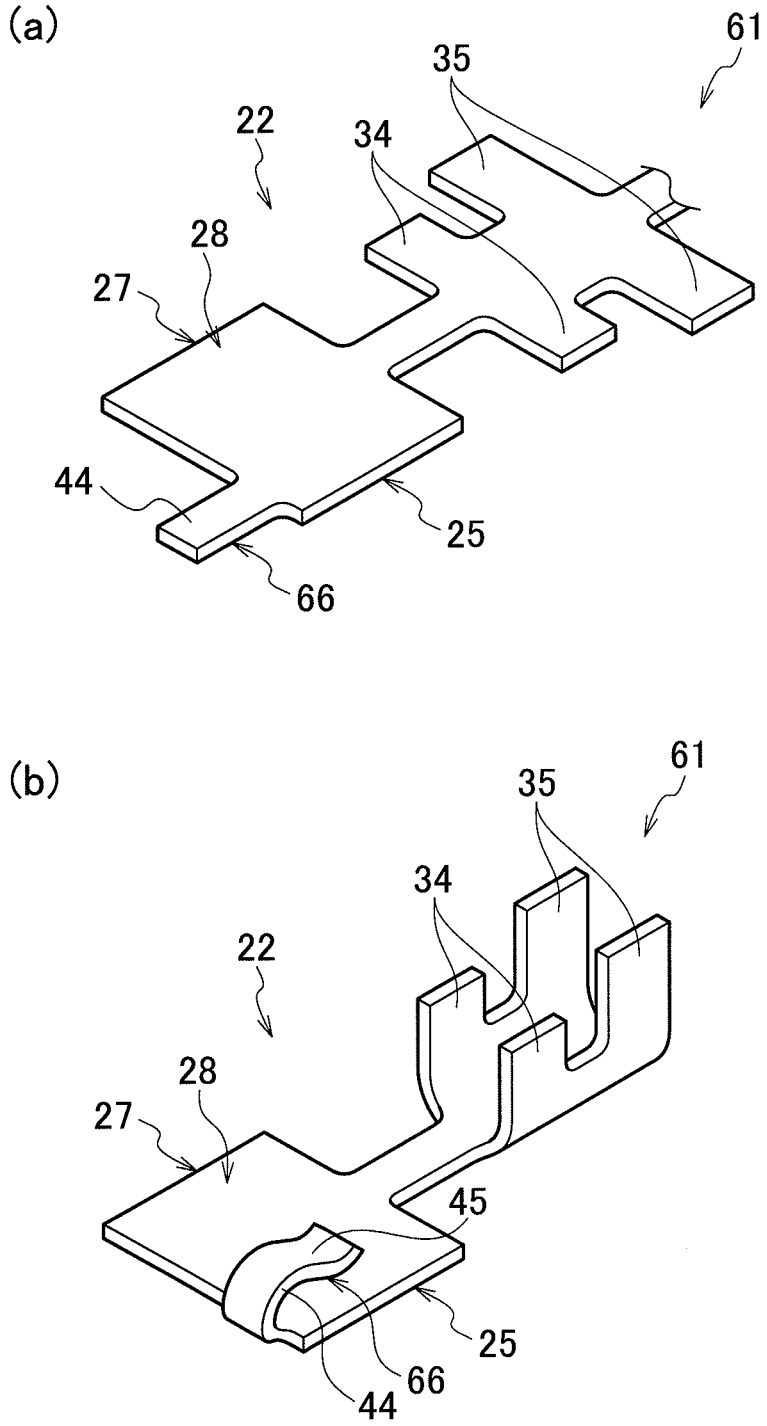
FIGS. 7(*a*) and 7(*b*) are perspective views illustrating a crimp terminal according to one of the other embodiments of the present invention.

As illustrated in FIGS. 7(*a*) and 7(*b*), the crimp terminal 61 according to another one of the other embodiments includes the first engagement portion 66 which is formed by bending a second plate piece 44 extended from the terminal engagement portion 22 to the opposite side to the conductor crimp portion 23 and jacket crimp portion 24 (see FIG. 2).

As illustrated in FIG. 7(*b*), the second plate piece 44 is bent into substantially the same shape as the first plate piece 42 to provide a second recess portion 45 which is formed at substantially the center of the second plate piece 44.

The second recess portion 45 of the second plate piece 44 and the terminal engagement portion 22 elastically sandwich the second engagement portion 28 formed in another crimp terminal. The first engagement portion 66 is thus engaged with the second engagement portion 28 of another crimp terminal.

Figure 8:
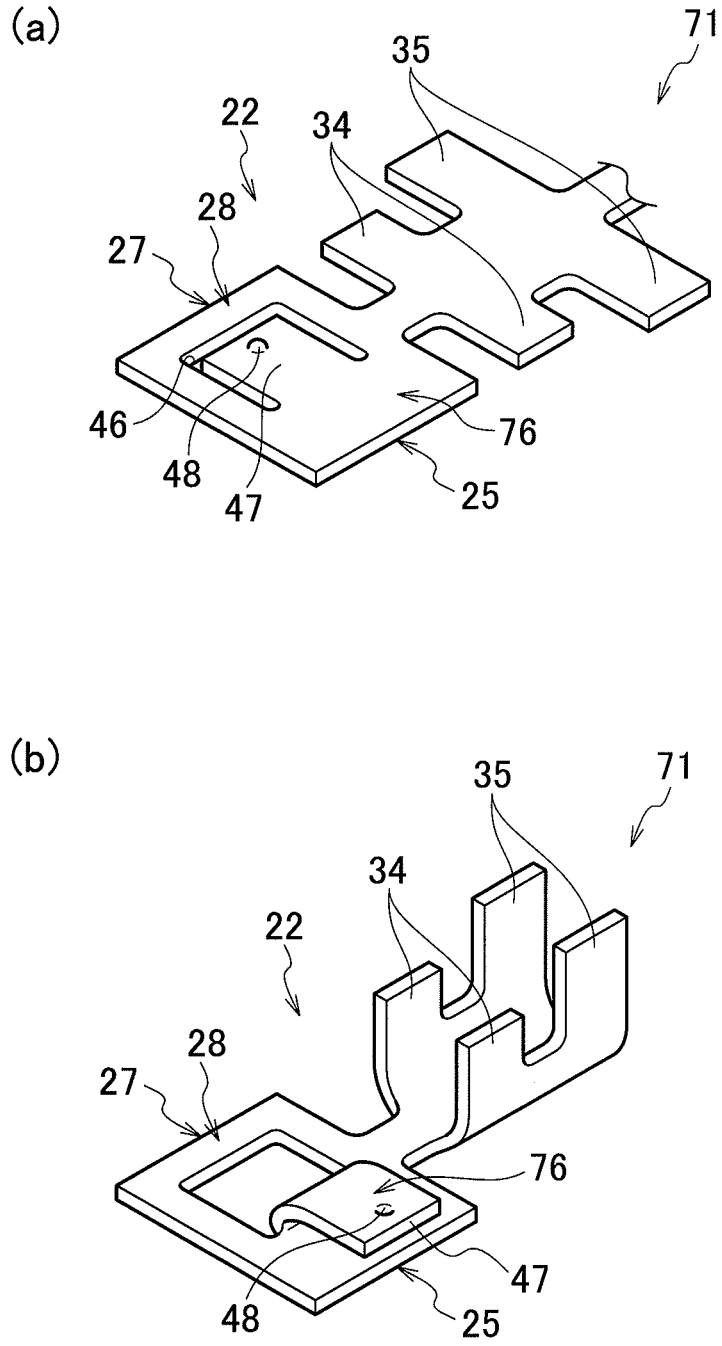
FIGS. 8(*a*) and 8(*b*) are perspective views illustrating a crimp terminal according to one of the other embodiments of the present invention.

As illustrated in FIGS. 8(*a*) and 8(*b*), the crimp terminal 71 according to still another one of the other embodiments includes a third plate piece 47, and the third plate piece 47 is formed by making a substantially U-shaped slit 46 in the terminal engagement portion 22. The third plate piece 47 is then bent toward the one end 25 in the width direction, thus forming the first engagement portion 76.

As illustrated in FIG. 8(*b*), the third plate piece 47 is provided with a first protrusion 48 protruding toward the terminal engagement portion 22 (downward in FIG. 8(*b*)).

The first protrusion 48 of the third plate piece 47 and the terminal engagement portion 22 elastically sandwich the second engagement portion 28 formed in another crimp portion. The first engagement portion 76 is thus engaged with the second engagement portion 28 of another crimp portion.

Figure 9:
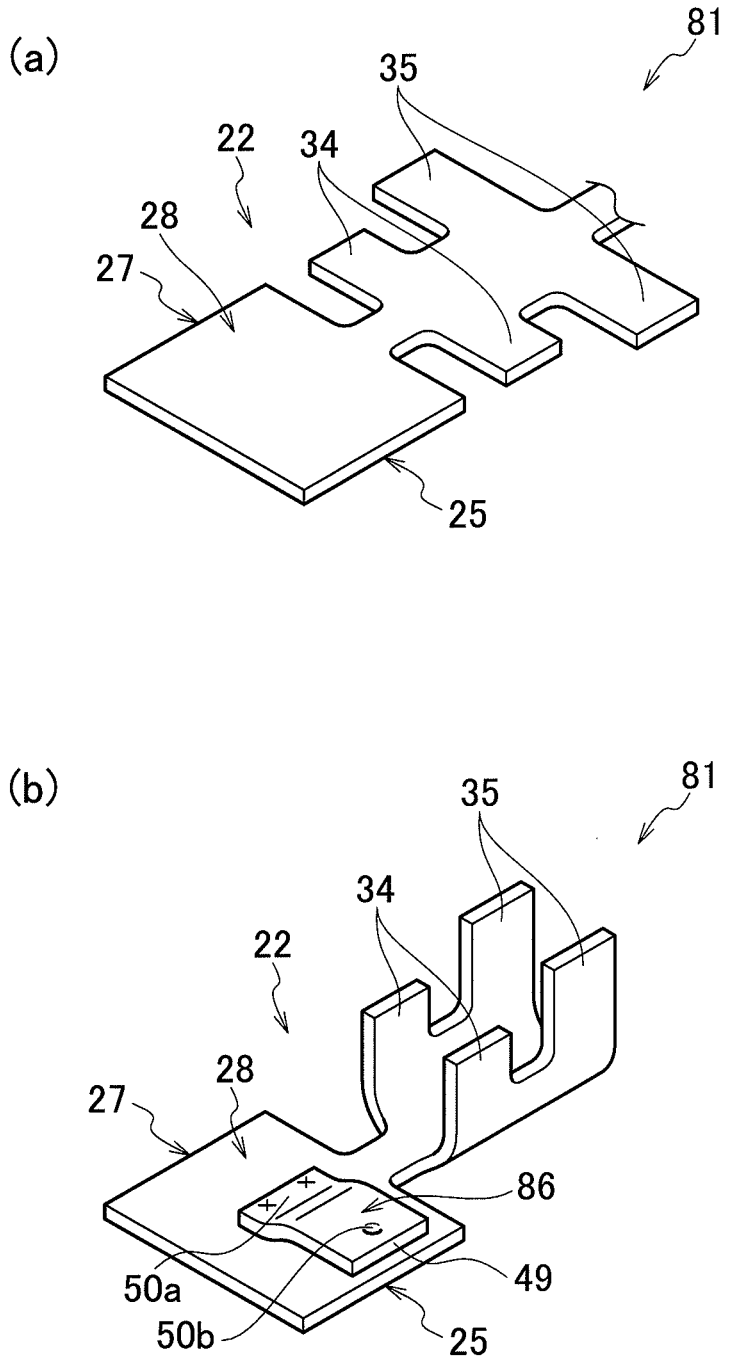
FIGS. 9(*a*) and 9(*b*) are perspective views illustrating a crimp terminal according to one of the other embodiments of the present invention.

As illustrated in FIGS. 9(*a*) and 9(*b*), the crimp terminal 81 according to still another one of the other embodiments is provided with the first engagement portion 86. The first engagement portion 86 is formed by welding a spring material 50*a* provided at one side of a fourth plate piece 49 to the terminal engagement portion 22.

As illustrated in FIG. 9(*b*), in the fourth plate piece 49 (at a side different from the spring material 50*a*), a second protrusion 50*b* protruding toward the terminal engagement portion 22 (downward in FIG. 8(*b*)) is formed.

The second protrusion 50*b* of the fourth plate piece 49 and the terminal engagement portion 22 elastically sandwich the second engagement portion formed in another crimp terminal. The first engagement portion 86 is thus engaged with the second engagement portion 28 of the another crimp terminal.

In the crimp terminals 61, 71, and 81 according to the other embodiments illustrated in FIGS. 7 to 9, the first engagement portions 66, 76, and 86 are formed on the opposite side to the conductor crimp portion 23 and jacket crimp portion 24 or in the longitudinal direction of the terminal engagement portion 22. Accordingly, the crimp terminals 61, 71, and 81 can be directly connected to one another when inserted into the terminal accommodating chambers 12 (see FIGS. 4 and 5).

The crimp terminals 61, 71, and 81 can be inserted into the terminal accommodating chambers 12 (see FIGS. 4 and 5) with the first engagement portions 66, 76, and 86 being engaged with the second engagement portion 28 of other crimp terminals, respectively.

Each of the crimp terminals 51, 61, and 71 illustrated in FIGS. 6 to 8 is formed by bending a single conductive metallic plate. Accordingly, bending of the first plate piece 42, second plate piece 44, and third plate piece 47 can be performed simultaneously with bending of the first crimp plate pieces 34 and second crimp plate pieces 35.

In the crimp terminals 51, 61, 71, and 81 according to the other embodiments, the first engagement portions 56, 66, 76, and 86 are formed at the one ends 25 of the terminal engagement portions 22, and the second engagement portions 28 which can be engaged with the first engagement portions 56, 66, 76, and 86 are formed at the other ends 27, respectively. Accordingly, by engaging the first engagement portions 56, 66, 76, and 86 with the second engagement portions 28 of other crimp terminals, the two or more crimp terminals can be directly connected to one another without using a busbar.

Moreover, since two or more crimp terminals 21 can be directly connected without using a busbar, the housing 11 does not need to include a space to attach a busbar. The joint connector 1 can be therefore miniaturized.

Furthermore, since two or more crimp terminals can be directly connected without using a busbar, the number of constituent components used to attach a busbar to the housing 11 can be reduced. This can reduce the process to manage constituent components and accordingly reduce the manufacturing cost.

It is therefore possible to provide the crimp terminals 51, 61, 71, and 81 which can be reduced in size and manufacturing cost.

In the crimp terminals 51, 61, 71, and 81 according to the other embodiments, the first engagement portions 56, 66, 76, and 86 are female types, and the second engagement portions 28 are male types. Accordingly, the first engagement portions 56, 66, 76, and 86 sandwich the second engagement portions 28 of other crimp terminals, and the second engagement portions 28 are sandwiched by the first engagement portions 56, 66, 76, and 86 of other crimp terminals. This can secure electrical connection of two or more crimp terminals without using a busbar.

Hereinabove, the crimp terminal and joint connector of the present invention are described based on the embodiments illustrated in the drawings. The present invention is not limited to these embodiments, and the configuration of each portion can be replaced with an arbitrary configuration having a similar function.

For example, the first engagement portion of the crimp terminal according to the present invention is not limited to the shapes of the first engagement portions 26, 56, 66, 76, and 86 of the crimp terminals 21, 51, 61, 71, and 81 described in each of the embodiments and can be properly changed as long as having a form which can sandwich the second engagement portions 28, respectively. Moreover, the second engagement portion of the crimp terminal according to the present invention is not limited to the shapes of the second engagement portions 28 of the crimp terminals 21, 51, 61, 71, and 81 described in each of the embodiments and can be properly changed as long as having a form which can be sandwiched by the first engagement portions 26, 56, 66, 76, and 86, respectively.

What is claimed is:

1. A joint connector, comprising:

a housing including a plurality of terminal accommodating chambers;

crimp terminals each insertable into each of the terminal accommodating chambers, each of the crimp terminals comprising a first engagement portion which is formed at one end in a direction orthogonal to a direction that each of the crimp terminals is inserted into each of the terminal accommodating chambers, and a second engagement portion which is formed at the other end in the direction orthogonal to the direction that each of the crimp terminals is inserted into each of the terminal accommodating chambers and has a shape engageable with the first engagement portion;

partition walls each separating two of the terminal accommodating chambers which are adjacent to each other in a width direction orthogonal to a direction that the crimp terminals are inserted into the terminal accommodating chambers; and slits each formed in each of the partition walls from a port through the direction that the crimp terminals are inserted into the terminal accommodating chambers, wherein one of the crimp terminals and another one of the crimp terminals are individually inserted in adjacent two of the terminal accommodating chambers, and the first engagement portion formed on the one of the crimp terminals and the second engagement portion formed on the another one of the crimp terminals are engaged with each other for electrical connection of the two or more crimp terminals and located in one of the slits, wherein each terminal accommodating chamber is defined by a bottom wall of the housing and two partition walls of the partition walls, and the first engagement portion formed on the one of the crimp terminals and the second engagement portion formed on the another one of the crimp terminals which are engaged to each other share a same partition wall which is one of two partition walls of each terminal accommodating chamber.

2. The joint connector according to claim 1, wherein the first engagement portion is a female type which sandwiches the second engagement portion of another one of the crimp terminal for electrical connection.

3. The joint connector according to claim 1, wherein the second engagement portion is a male type which is sandwiched by the first engagement portion of another one of the crimp terminal.

* * * * *